US006267369B1

(12) United States Patent
Regimbal et al.

(10) Patent No.: US 6,267,369 B1
(45) Date of Patent: Jul. 31, 2001

(54) TORQUE LOADING OF A SHEET MATERIAL FEED ROLLER

(75) Inventors: Laurent A. Regimbal, Eagle, ID (US); Scott K. Carter, Jr., Holzgerlingen (DE); Hernan I. Gutierrez Vazquez, Guadalajara Jalisco; Francisco J. Camino-Escudero, Zapopan Jalisco, both of (MX)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/347,430

(22) Filed: Jul. 2, 1999

(51) Int. Cl.[7] ..... B65H 3/06
(52) U.S. Cl. ..... 271/114; 271/109; 271/117
(58) Field of Search ..... 271/109, 114, 271/117, 118

(56) References Cited

U.S. PATENT DOCUMENTS

| | | | | |
|---|---|---|---|---|
| 3,737,158 | * | 6/1973 | Beery et al. | 271/117 |
| 4,395,033 | * | 7/1983 | Janssen et al. | 271/110 |
| 4,475,732 | * | 10/1984 | Clausing et al. | 271/118 |
| 4,934,686 | * | 6/1990 | Ono et al. | 271/117 |
| 5,547,181 | * | 8/1996 | Underwood | 271/117 |
| 5,624,109 | * | 4/1997 | Tanaka | 271/118 |
| 5,755,435 | * | 5/1998 | Fujiwara | 271/118 |
| 6,059,279 | * | 5/2000 | Wenthe | 271/114 |

FOREIGN PATENT DOCUMENTS

| | | | | |
|---|---|---|---|---|
| 0347889 | * | 12/1989 | (EP) | 271/117 |
| 0123036 | * | 5/1990 | (JP) | 271/117 |
| 405301645 A | * | 11/1993 | (JP) | 271/118 |

* cited by examiner

*Primary Examiner*—H. Grant Skaggs

(57) ABSTRACT

A sheet material feed roller assembly including a feed roller mounted for contact with a stack of sheet material is disclosed. A variable load motor is provided that is adapted and constructed to cause the feed roller to apply a variable normal force to a top sheet of the stack of sheet material. A force transfer linkage is mounted between the feed roller and the torque load motor. The force transfer linkage is adapted and constructed to transfer force from the torque load motor to the feed roller. The transfer linkage can be provided as an elongate arm member including a first end upon which the feed roller is mounted, and a second, opposite end upon which the load motor is mounted. In an embodiment, the elongate arm member has a length of approximately 60 mm. A computer-controlled variable power source can be connected to the load motor, and an encoder can be connected between the power source and the motor. The motor can be provided as a stepper motor or a DC motor. The feed roller can be provided as a gear wheel. A method of torque loading a sheet material feed roller in an imaging apparatus including a sheet material feed mechanism is also provided. The method includes the steps of providing a feed roller mounted for contact with a stack of sheet material, and providing a variable torque load motor adapted and constructed to cause the feed roller to selectively apply a normal force to a top sheet of the stack of sheet material. The torque load motor is then actuated to cause the feed roller to selectively apply a normal force to a top sheet of the stack of sheet material.

20 Claims, 2 Drawing Sheets

TORQUE LOADING OF A SHEET MATERIAL FEED ROLLER

FIELD OF THE INVENTION

The present invention relates to sheet material feed mechanisms. More specifically, the present invention relates to torque loading of sheet material feed rollers associated with imaging devices such as printers, copiers, and fax machines.

BACKGROUND OF THE INVENTION

Imaging systems such as printers, fax machines, and copiers are virtually omnipresent, and can be found in homes and offices worldwide. The development of such systems has facilitated improvements in communication that have in turn fostered a sea of change in the way people live and work. Telecommuting, paperless offices, and intra-office networks represent but a few examples of the advancements that have been made possible by modern imaging systems.

Since these systems have become crucial to everyday existence, their reliability and smooth operation is paramount. It is therefore vitally important to design imaging systems so that downtime and work interruptions are minimized. This can be a daunting challenge, given the relative complexity of systems in which sheet material must be infed, moved through the imaging process, and outfed in a matter of seconds.

It has been found that the difference in weight between smaller and larger sheet sizes, differences in weight between thicker and thinner sheets, and different sheet surface textures can present problems in sheet feeding throughout the imaging system. For each combination of these factors, successful transportation of sheet material depends upon applying the proper amount of applied force on the sheet with a feed mechanism such as a roller. The combination of forces is shown in FIG. 1. When torque T is applied to the roller R, the combination of torque and normal force N produces a transport force P, which causes the sheet material to move. Accurate application of the applied force A transmitted through the roller R allows the system designer to produce the desired normal and transport forces appropriate for a particular sheet material.

The consequences of incorrect forces can be problematic. Using the infeed mechanism as an example, if the applied force is too low, sheets can have "no-pick" problems, where the transport force is insufficient to remove the sheets from the stack. At the other end of the spectrum, if the force is too great, the result may be "multi-feed" problems, wherein the transport force introduces several sheets into the feed mechanism simultaneously. Excess force can also cause deformation of one or more of the underlying sheets.

Known approaches to address these difficulties involve using springs or weights to produce a load on the feed roller. Spring-loaded systems typically use coil or leaf springs to apply force to the feed rollers. Examples of such systems are set forth in U.S. Pat. Nos. 5,163,666 to Kuo and 5,474,288 to Lo et al.

Spring systems are effective to a degree, but have significant drawbacks as well. For example, spring constants often have relatively high tolerances about their stated nominal values, sometimes in the range of 10% to 20%. Such variation in force produces unacceptable variation in transport force in an imaging system. Further, if the feed roller must accommodate different stack heights, the applied force exerted by the spring frequently changes the load on the sheet material as the angle and height of the roller varies.

Systems using weights employ a fixed, known mass to apply force to the feed roller. Such systems are relatively accurate for applying a specified load. Unfortunately, the required forces for feed rollers often dictate a weight whose physical size would be impractical to incorporate into the housing design for an imaging system. Additionally, the effect of the weight on the roller would be dependent on the orientation of the system, thus requiring a level resting surface. Further, weight systems can be subject to the same stack height problems discussed with reference to spring systems.

Neither spring systems nor weight systems has the ability to compensate for other variables in the imaging system. These variables can include such things as changes in friction at hinge points of arms and the like due to manufacturing tolerances, temperature variations, or wear. These have the potential to change the applied force, thus negatively affecting the transport force.

It can thus be seen that the need exists for a reliable and predictable way to transmit applied force to a feed roller associated with imaging devices such as printers, copiers, and fax machines.

SUMMARY OF THE INVENTION

These and other objects are achieved by providing a sheet material feed roller assembly including a feed roller mounted for contact with a stack of sheet material. A variable load motor is provided that is adapted and constructed to cause the feed roller to apply a variable normal force to a top sheet of the stack of sheet material. A force transfer linkage is mounted between the feed roller and the torque load motor The force transfer linkage is adapted and constructed to transfer force from the torque load motor to the feed roller.

The transfer linkage can be provided as an elongate arm member including a first end upon which the feed roller is mounted, and a second, opposite end upon which the load motor is mounted. In an embodiment, the elongate arm member has a length of approximately 60 mm.

A computer-controlled variable power source can be connected to the load motor, and an encoder can be connected between the power source and the motor. The motor can be provided as a stepper motor or a DC motor. The feed roller can be provided as a gear wheel.

A method of torque loading a sheet material feed roller in an imaging apparatus including a sheet material feed mechanism is also provided. The method includes the steps of providing a feed roller mounted for contact with a stack of sheet material, and providing a variable torque load motor adapted and constructed to cause the feed roller to selectively apply a normal force to a top sheet of the stack of sheet material. The torque load motor is then actuated to cause the feed roller to selectively apply a normal force to a top sheet of the stack of sheet material.

The features of the invention believed to be patentable are set forth with particularity in the appended claims. The invention itself, however, both as to organization and method of operation, together with further objects and advantages thereof, may be best understood by reference to the following description taken in conjunction with the accompanying drawings.

DETAILED DESCRIPTION OF THE INVENTION

Figure 1:
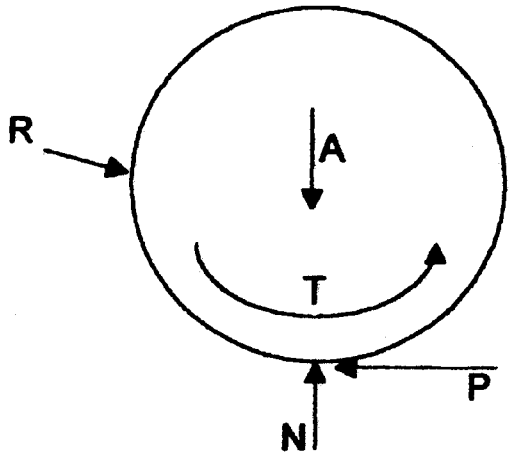
FIG. 1 is a schematic illustration of the forces acting on a feed roller, as described in the Background of the Invention.
Figure 2:
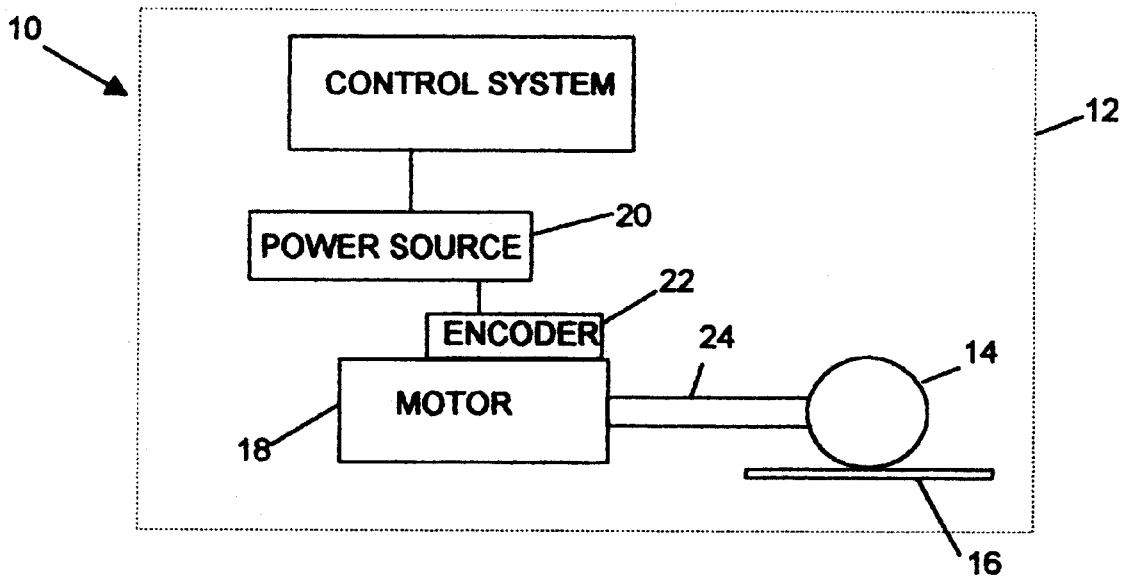
FIG. 2 is a schematic illustration of a sheet material feed roller assembly in accordance with the principles of the present invention.

A sheet material feed roller assembly 10 in accordance with the principles of the present invention is shown in FIG. 1. The feed roller assembly 10 can be provided in association with an imaging device 12, such as a printer, copier, or fax machine. The feed roller assembly 10 includes a feed roller 14 mounted for contact with sheet material 16 that is to be transported through the device 12. The sheet material 16 can be any sheet material suitable for use in imaging devices, such as paper, card stock, or plastic transparency material.

A variable load motor 18 is provided that is adapted and constructed to cause the feed roller 14 to apply a variable normal force to the sheet material 16. The motor 18 can be provided as any suitable electronically controllable motor, such a stepper motor or a DC motor. A computer-controlled variable power source 20 can be connected to the motor 18. An encoder 22 can be connected between the power source 20 and the motor 18 in a known manner to facilitate control of the motor 18.

A force transfer linkage 24 is mounted between the feed roller 14 and the motor 18, and is adapted and constructed to transfer force from the motor 18 to the feed roller 14.

Figure 3:
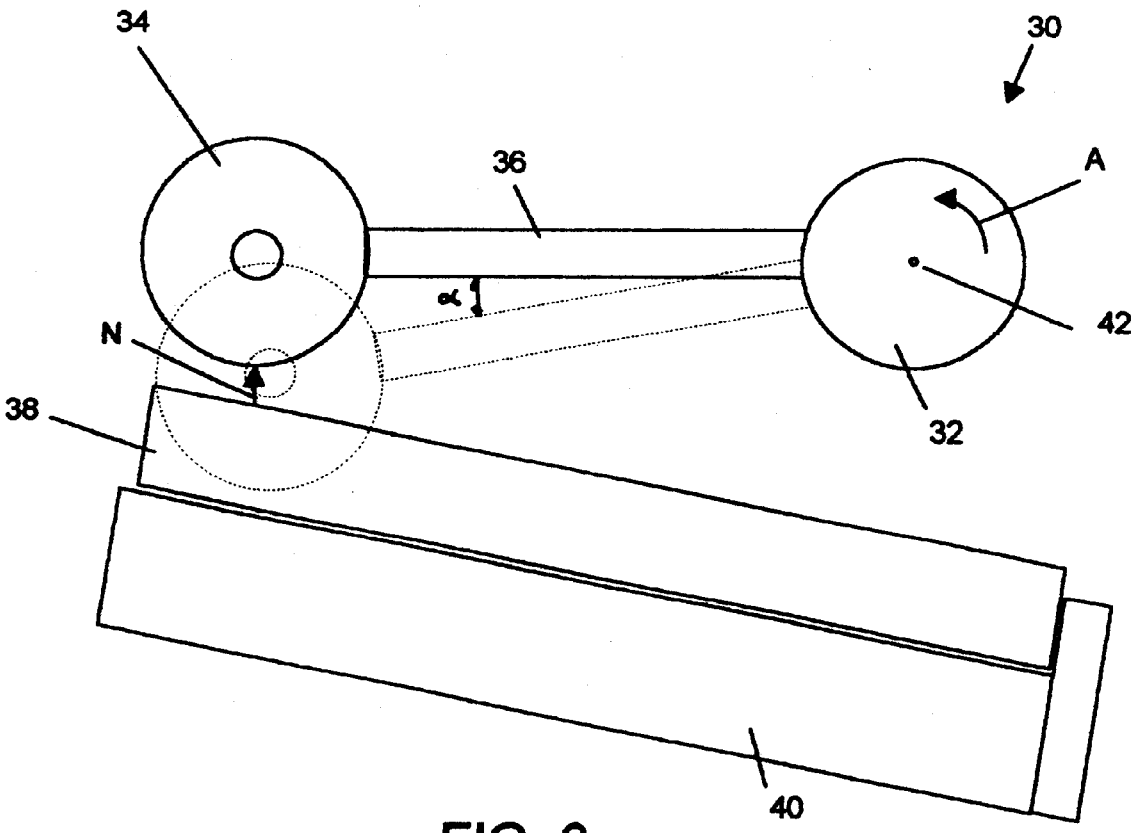
FIG. 3 is a schematic illustration of a sheet material feed roller assembly including torque loading of a roller.

A feed roller assembly 30 illustrates a specific application of the principles of the present invention as shown in FIG. 3. A torque load motor 32 is connected to a gear wheel assembly 34 by means of a transfer linkage provided as an rotatable elongate arm member 36. The torque motor 32 produces torque which is transferred through the lever arm 36 as an applied force on the gear wheel 34, determining the transport force on the top sheet of a stack of sheet material 38 located in an accumulator 40. The forces involved can be defined as follows:

Where:

$T_A$=Torque applied by motor 32;

L=Length of the lever arm 36;

$F_N$=Normal force;

=Angle of the arm 36 with respect to the sheet material.

The sum of moments about the pivot point 42 of the arm 36 is:

$$\Sigma M_o = T_A - F_N * L\cos\alpha$$

$$T_A = F_N * L\cos\alpha$$

$$F_N = T_A / L\cos\alpha$$

For small values of $\alpha(\alpha \leqq 15°)$, $\cos\alpha \cong 1$ (a margin of error of <5%).

Thus, $F_N \cong T_A/L$ for $\alpha \leqq 15°$.

Using an exemplary arm length $L \cong 60$ mm, a sheet stack could vary from 0 to 16 mm without significant transport force error due to angular displacement. As will be appreciated from the foregoing, taller stacks could be accommodated with a longer arm and/or with more firmware compensation.

In operation, the torque load motor 32 is actuated to cause the feed roller 34 to selectively apply a normal force to a top sheet of the stack of sheet material. The motor can move the arm during a calibration phase to determine the appropriate force level required to move the arm 36 and overcome any friction or other resistive forces not associated with pressing the roller 34 against the sheet material 38. After calibration, the roller 34 can be pressed against the sheet material 38 with an accurately controlled torque value taking into consideration only the pertinent transport characteristics of the sheet material itself.

Although the present invention has been described with reference to specific embodiments, those of skill in the art will recognize that changes may be made thereto without departing from the scope and spirit of the invention as defined by the appended claims.

What is claimed is:

1. A sheet material feed roller assembly comprising the following:

a rotationally driven feed roller mounted for contact with a stack of sheet material;

a variable load motor adapted and constructed to cause the feed roller to apply a variable normal force to a top sheet of the stack of sheet material; and a force transfer linkage mounted between the feed roller and the variable load motor, the force transfer linkage being adapted and constructed to transfer force from the variable load motor to the feed roller.

2. A sheet material feed roller assembly according to claim 1, wherein the transfer linkage comprises an elongate arm member.

3. A sheet material feed roller assembly according to claim 2, wherein the elongate arm member comprises a first end upon which the feed roller is mounted, and a second, opposite end upon which the load motor is mounted.

4. A sheet material feed roller assembly according to claim 3, wherein the elongate arm member has a length of approximately 60 mm.

5. A sheet material feed roller assembly according to claim 1, further comprising a variable power source connected to the load motor.

6. A sheet material feed roller assembly according to claim 5, wherein the variable power source comprises a computer-controlled power source.

7. A sheet material feed roller assembly according to claim 6, further comprising an encoder connected between the power source and the motor.

8. A sheet material feed roller assembly according to claim 7, wherein the motor comprises a stepper motor.

9. A sheet material feed roller assembly according to claim 7, wherein the motor comprises a DC motor.

10. A sheet material feed roller assembly according to claim 1, wherein the feed roller comprises a gear wheel.

11. In an imaging apparatus including a sheet material feed mechanism, a sheet material feed roller assembly comprising the following:

a rotationally driven feed roller mounted for contact with a stack of sheet material;

a variable load motor adapted and constructed to cause the feed roller to apply a variable normal force to a top sheet of the stack of sheet material; and a force transfer linkage mounted between the feed roller and the variable load motor, the force transfer linkage being adapted and constructed to transfer force from the variable load motor to the feed roller.

12. A sheet material feed roller assembly according to claim 11, wherein the transfer linkage comprises an elongate arm member.

13. A sheet material feed roller assembly according to claim 12, wherein the elongate arm member comprises a first end upon which the feed roller is mounted, and a second, opposite end upon which the load motor is mounted.

14. A sheet material feed roller assembly according to claim 13, wherein the elongate arm member has a lever arm length of approximately 60 mm.

15. A sheet material feed roller assembly according to claim 11, further comprising a variable power source connected to the load motor.

16. A sheet material feed roller assembly according to claim 15, wherein the variable power source comprises a computer-controlled power source.

17. A sheet material feed roller assembly according to claim 16, further comprising an encoder connected between the power source and the motor.

18. A sheet material feed roller assembly according to claim 17, wherein the motor comprises a stepper motor.

19. A sheet material feed roller assembly according to claim 17, wherein the motor comprises a DC motor.

20. In an imaging apparatus including a sheet material feed mechanism, a method of torque loading a sheet material feed roller, the method comprising the following steps:

providing a rotationally driven feed roller mounted for contact with a stack of sheet material;

providing a variable load motor adapted and constructed to cause the feed roller to apply a variable normal force to a top sheet of the stack of sheet material;

mounting a force transfer linkage between the feed roller and the variable load motor, the force transfer linkage being adapted and constructed to transfer force from the variable load motor to the feed roller; and actuating the variable load motor to cause the feed roller to selectively apply a selectively variable normal force to a top sheet of the stack of sheet material via the transfer linkage.

* * * * *